US007185514B2

(12) United States Patent
Paradowski

(10) Patent No.: US 7,185,514 B2
(45) Date of Patent: Mar. 6, 2007

(54) METHOD AND INSTALLATION FOR FRACTIONATING GAS DERIVED FROM PYROLYSIS OF HYDROCARBONS

(75) Inventor: Henri Paradowski, Cergy (FR)

(73) Assignee: Technip France (FR)

( * ) Notice: Subject to any disclaimer, the term of this patent is extended or adjusted under 35 U.S.C. 154(b) by 334 days.

(21) Appl. No.: 10/487,655

(22) PCT Filed: Aug. 28, 2002

(86) PCT No.: PCT/FR02/02952

§ 371 (c)(1),
(2), (4) Date: Mar. 15, 2004

(87) PCT Pub. No.: WO03/023304

PCT Pub. Date: Mar. 20, 2003

(65) Prior Publication Data

US 2004/0237581 A1 Dec. 2, 2004

(30) Foreign Application Priority Data

Sep. 13, 2001 (FR) ..... 01 11867

(51) Int. Cl.
*F25J 3/00* (2006.01)

(52) U.S. Cl. ..... 62/620; 62/619; 62/623

(58) Field of Classification Search ..... 62/600, 62/619, 623, 620, 630, 617, 618, 929
See application file for complete search history.

(56) References Cited

U.S. PATENT DOCUMENTS 3,813,890 A * 6/1974 Bligh ..... 62/623
4,072,485 A 2/1978 Becdelievre et al.
4,121,917 A 10/1978 Baker et al.
4,436,540 A * 3/1984 Dowd et al. ..... 62/630
4,449,994 A * 5/1984 Hegarty et al. ..... 62/622
5,377,490 A 1/1995 Howard et al.

FOREIGN PATENT DOCUMENTS

JP 54 136 574 10/1979

OTHER PUBLICATIONS

International Search Report.

* cited by examiner

*Primary Examiner*—Cheryl Tyler
*Assistant Examiner*—Michael J. Early
(74) *Attorney, Agent, or Firm*—Ostrolenk, Faber, Gerb & Soffen, LLP

(57) ABSTRACT

The invention relates to a method for fractionating a gas produced by the pyrolysis of hydrocarbons (1) for the recovery of $C_2$ and higher hydrocarbons, in particular ethylene and ethane, comprising an operation (70) for compressing and drying gas (1) as a result of it passing into a series of compressors (3, 10, 17, 24, 36), an operation (80) for progressively cooling and partially liquefying the gas produced by compression and drying operation (70) as a result of it successively passing into a cryogenic exchanger (62), and a distillation operation (90) in a column (64), and the corresponding installation.

According to the invention, cryogenic exchanger (62) is cooled by at least one cooling liquid (400) which is liquid natural gas (LNG).

10 Claims, 1 Drawing Sheet

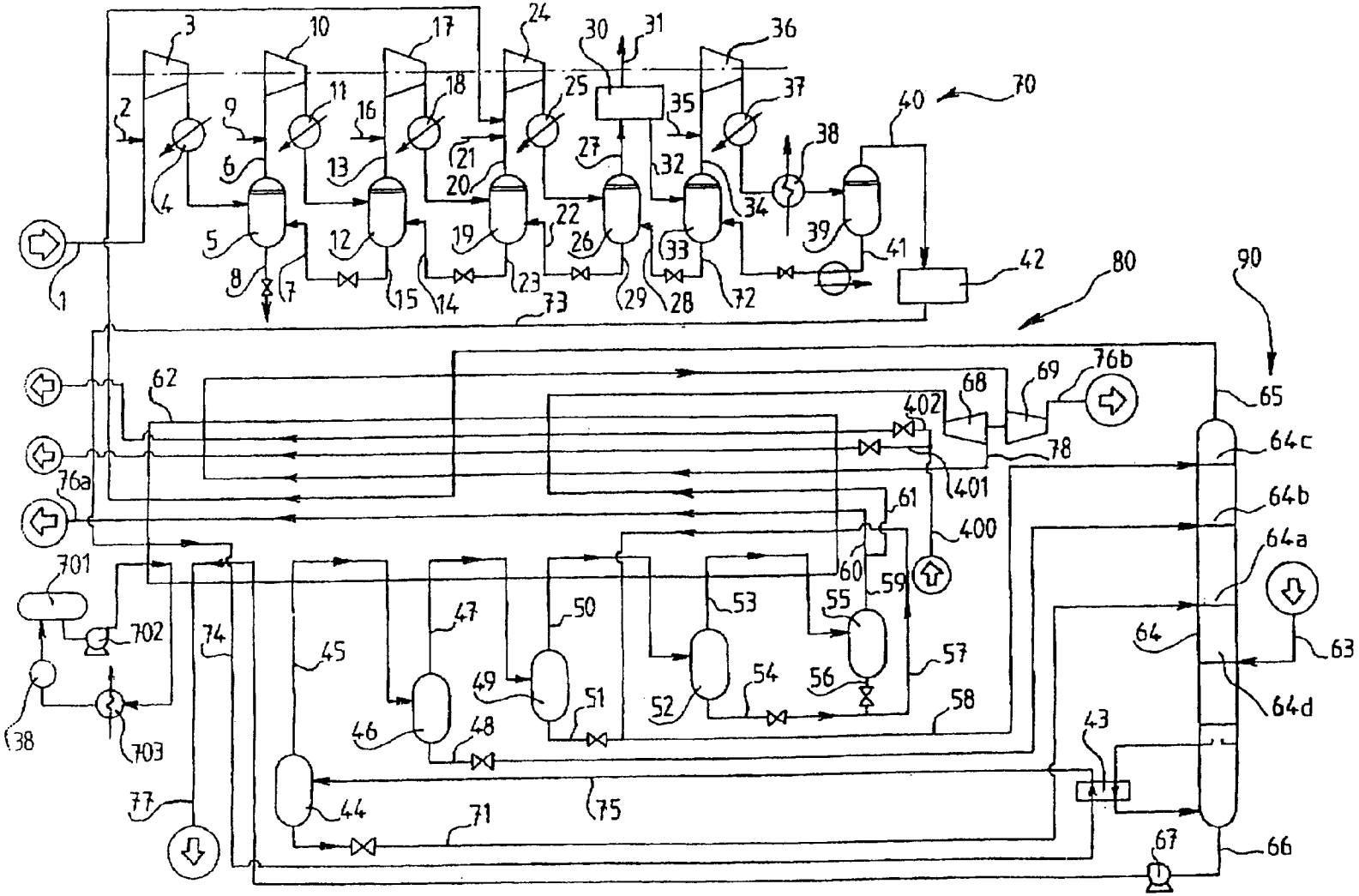

METHOD AND INSTALLATION FOR FRACTIONATING GAS DERIVED FROM PYROLYSIS OF HYDROCARBONS

The present invention relates generally and in a first aspect to the methods of fractionating hydrocarbon pyrolysis gas and in a second aspect to industrial installations and equipment enabling these methods to be carried out.

More precisely, the present invention relates to a method of fractionating a gas produced by the pyrolysis of hydrocarbons, encompassing hydrogen and hydrocarbons, in particular $C_1$ to $C_4$ hydrocarbons including ethylene, ethane and methane, possibly water and $CO_2$, into at least a first current enriched in hydrogen and methane, possibly at least a second current essentially consisting of water, and into at least a third current containing most of the other $C_2$ and higher hydrocarbons, in particular ethylene and ethane, comprising:

a) an operation for compressing and drying the gas as a result of it passing into a series of compressors each connected to a cooler and a separator, and further comprising a $CO_2$-removal stage, should the gas contain a surplus thereof, in order to obtain a compressed gas, b) an operation for progressively cooling and partially liquefying the compressed gas produced by the compression and drying operation as a result of it successively passing into a cryogenic exchanger and being separated in separators into (i) liquids enriched in $C_2$ and higher hydrocarbons, in particular in ethylene and ethane, but low in hydrogen and methane, and into (ii) gases depleted in $C_2$ and higher hydrocarbons, in particular in ethylene and ethane, each successive passage into the cryogenic exchanger bringing the gas to a relatively lower temperature and therefore allowing the hydrocarbons to be liquefied in a more complete manner, the gas produced by the last separator making up the first current essentially containing hydrogen and methane and a very small amount of ethylene and ethane, this gas then being heated in the cryogenic exchanger and collected, c) a distillation operation in a column, supplied at various levels with the liquids collected during the preceding operation and which are partially expanded, said column allowing the separation, into a relatively colder upper part, of a gaseous top current enriched in methane and depleted in ethylene and ethane, and, into a relatively less cold lower part, of a liquid bottom current depleted in methane and enriched in ethylene and ethane, the top current being heated in the cryogenic exchanger and recycled to the compression and drying operation upstream of the compressor, the feed pressure of which is closest to the operating pressure of the column, the bottom current being heated in the cryogenic exchanger and collected and making up the third current.

According to another aspect, the invention relates to an installation for fractionating a gas produced by the pyrolysis of hydrocarbons, encompassing hydrogen and hydrocarbons, in particular $C_1$ to $C_4$ hydrocarbons including ethylene, ethane and methane, and possibly water and $CO_2$, into at least a first current enriched in hydrogen and methane, possibly at least a second current essentially consisting of water, and into at least a third current containing most of the other $C_2$ and higher hydrocarbons, in particular ethylene and ethane, comprising:

a) a unit for compressing and drying the gas as a result of it passing into a series of compressors each connected to a cooler and a separator, further comprising a $CO_2$-removal stage, should the gas contain a surplus thereof, in order to obtain a compressed gas, b) a unit for progressively cooling and partially liquefying the gas produced by the compression and drying unit as a result of it successively passing into a cryogenic exchanger and being separated in separators into (i) liquids enriched in $C_2$ and higher hydrocarbons, in particular in ethylene and ethane, but low in hydrogen and methane, and into (ii) gases depleted in $C_2$ and higher hydrocarbons, in particular in ethylene and ethane, each successive passage into the cryogenic exchanger bringing the gas to a relatively lower temperature and therefore allowing the hydrocarbons to be liquefied in a more complete manner, the gas produced by the last separator making up the first current essentially containing hydrogen and methane and a very small amount of ethylene and ethane, this gas then being heated in the cryogenic exchanger and collected, c) a distillation unit essentially comprising a column, supplied at various levels with the liquids collected in the preceding unit and which are partially expanded, said column allowing the separation, into a relatively colder upper part, of a gaseous top current enriched in methane and depleted in ethylene and ethane, and, into a relatively less cold lower part, of a liquid bottom current depleted in methane and enriched in ethylene and ethane, the top current being heated in the cryogenic exchanger and recycled in the compression and drying unit upstream of the compressor, the feed pressure of which is closest to the operating pressure of the column, the bottom current being heated in the cryogenic exchanger and collected and making up the third current.

Said method makes use of, and said installation comprises, a cryogenic exchanger with a thermal power of several dozen MW for generally considered gas-fractionating capacities. Supplying this exchanger with liquid coolant, for example ethylene, requires complex and costly secondary and tertiary cycles. It is estimated that for a gas-fractionating installation with a capacity of 250 tonnes/hour, the total cost of the secondary and tertiary loops is approximately 8 million Euros per year.

It is also known that natural gas is, in some cases, transported in liquid form and stored in this form upon arrival at terminals. Before being injected into a transport and distribution network, an operation of regasifying the liquid natural gas (LNG) is required. This is notably carried out in heat exchangers cooled by river water circulation as described in the document "How Gaz de France optimizes LNG regasification", May 5, 1986 Oil and Gaz Journal, pp 149–154. LNG has a considerable refrigerating potential as a result of its extremely low temperature of approximately minus 100° C., which, in the case of the regasification operations of the type cited above, has neither been used nor developed for 50 years in Europe and America. In some cases, when the temperature of the cooling water is too low, the LNG is regasified by the combustion of a gas part, which naturally leads to an overconsumption of energy which is contrary to the current requirements of reducing the production of greenhouse gases.

The present invention aims to resolve the situation described above by using the refrigeration produced during the operation of regasifying the LNG to cool the cryogenic exchanger, hereby allowing the secondary circuit of the installation for fractionating pyrolysis gas to be significantly reduced and the tertiary circuit to be eliminated. This results in savings for the operator of this installation and a large reduction in the amount of cooling fluids required for the installation and therefore large energy savings.

To this end, the invention, in a first aspect, in accordance moreover with the generic definition given in the preamble, is characterised in that the cryogenic exchanger used in the method of fractionating pyrolysis gas is feed with at least one cooling fluid which is LNG.

According to one of the advantageous aspects of the method according to the invention, the temperature of the LNG upon entering the cryogenic exchanger can vary from minus 89° C. to minus 160° C.

According to one of the advantageous aspects of the method according to the invention, the cryogenic exchanger is fed with two streams of LNG, a high-pressure stream at a first, relatively higher pressure and a medium pressure stream at a second, relatively lower pressure.

According to one of the advantageous aspects of the method according to the invention, the medium pressure stream of LNG feeding the cryogenic exchanger is produced by deriving a part of the high pressure stream and expanding said stream in order to reduce its temperature, the flow rate of the medium pressure stream depending on the temperature of the LNG and being all the more large since this temperature is high.

In a second aspect, the invention, moreover in accordance with the generic definition given in the preamble, is characterised in that the cryogenic exchanger of the installation for fractionating pyrolysis gas is fed with at least one cooling fluid which is LNG.

According to one of the advantageous aspects of the installation according to the invention, the temperature of the LNG upon entering the cryogenic exchanger can vary from minus 89° C. to minus 160° C.

According to one of the advantageous aspects of the installation according to the invention, the cryogenic exchanger is fed with two streams of LNG, a high-pressure stream at a first, relatively higher pressure and a medium pressure stream at a second, relatively lower pressure.

According to one of the advantageous aspects of the installation according to the invention, the medium pressure stream of LNG feeding the cryogenic exchanger is produced by deriving a part of the high pressure stream and by expanding said stream in order to lower its temperature, the flow rate of the medium pressure stream depending on the temperature of the LNG and being all the more large since this temperature is high.

Other advantageous characteristics of the invention will emerge from the description given below, by way of informative and non-limiting example, with reference to the appended drawing:

plate 1/1 is a simplified process diagram of an installation for fractionating hydrocarbon pyrolysis gas according to the invention.

The supply of gas produced by the pyrolysis of hydrocarbons is shown by line 1 of FIG. 1. The characteristics of this gas are typically as follows: temperature 40° C., pressure 1.5 absolute bar, total mass flow rate approximately 257 tonnes/hour, the mass flow rates in kg/h of the main components of this stream being approximately:

| Water | $H_2$ | CO | $CO_2$ | Methane | Ethylene | Ethane |
|---|---|---|---|---|---|---|
| 12200 | 9800 | 260 | 40 | 11700 | 127100 | 83700 |

| Propene | 1,3-Butadiene | n-Butane | Benzene |
|---|---|---|---|
| 2700 | 3100 | 1400 | 3500 |

The values for flow rates, temperatures and pressures indicated in the description below are values obtained by numerical simulation of the process in a typical embodiment.

Stream 1 firstly undergoes an operation 70 comprising 5 almost identical stages of compression and drying and a $CO_2$-removal stage.

In the course of the first stage, stream 1 receives a slight addition of water 2, is then compressed using a compressor 3 to a pressure of 3 absolute bar, which results in an associated rise in temperature to 93° C. This stream 1 is then cooled to 45° C. in a water-cooled heat exchanger 4, causing the condensation of a part of the water vapour. Stream 1 thus feeds a separator 5 allowing a top stream 6 substantially representing the gaseous fraction of stream 1 and a bottom stream 8 where the condensates of stream 1 are located to be separated. Separator 5 is also fed with an essentially liquid stream 7, made up of the condensates of the following drying stages, said condensates passing almost completely into stream 8.

Stream 6 then undergoes a second stage of treatment comprising, as the first stage, an addition of water 9, compression to 5.3 absolute bar and 91° C. using a compressor 10, cooling to 45° C. using an exchanger 11, then separation in a separator 12. Separator 12 is also fed with an essentially liquid stream 14, made up of the condensates of the following drying stages. These streams are separated into a gaseous top stream 13 and a liquid bottom stream 15, which, after expansion, makes up feed stream 7 of separator 5.

Stream 13 undergoes a third treatment stage comprising, as the first stage, an addition of water 16, compression to 10.1 absolute bar and 91° C. using a compressor 17, cooling to 45° C. using an exchanger 18, then separation in a separator 19. Separator 19 is also fed with an essentially liquid stream 22 made up of the condensates of the following drying stages. These streams are separated into a gaseous top stream 20 and into a liquid bottom stream 23, which, after expansion, makes up feed stream 14 of separator 12.

Gaseous stream 20 receives an addition of water 21 and is mixed with a recycled gaseous stream 65 coming from the head of a distillation column 64. This stream 65 will be described below. Its mass flow rate is approximately 27900 kg/h, its pressure 10 absolute bar and its temperature 40° C. As above, these three combined streams undergo compression to 19.3 absolute bar and 90° C. using a compressor 24, cooling to 45° C. using an exchanger 25, then separation in a separator 26. Separator 26 is also fed with an essentially liquid stream 28 made up of the condensates of the following drying stages. These streams are separated into a gaseous top stream 27 and a liquid bottom stream 29, which, after expansion, makes up feed stream 22 of separator 19.

Gaseous stream 27 then undergoes a $CO_2$-removal operation by means of washing with soda in equipment 30, producing a stream 31 comprising at least almost all of the $CO_2$ which was initially contained in stream 27, and a stream 32 depleted in $CO_2$ which then feeds a separator 33. Separator 33 is also fed with an essentially liquid stream 41 made up of the condensates of the last drying stage. These streams are separated into a gaseous top stream 34 and a liquid bottom stream 72, which, after expansion, makes up feed stream 28 of separator 26.

Gaseous stream 34 receives an addition of water 35 and undergoes as above compression to 34.3 absolute bar and 88° C. using a compressor 36, cooling to 45° C. using an exchanger 37, then secondary cooling to 15° C. using an exchanger 38 cooled by a butane cycle which will be described below, and finally separation in a separator 39. Stream 34 is separated into a gaseous top stream 40 and into a liquid bottom stream 41, which, after cooling and expansion, feeds separator 33.

Gaseous stream 40 then undergoes a final dehydration in dryer 42 allowing the remaining traces of water to be eliminated and producing stream 73.

All of the condensates collected in separators 5, 12, 19, 26, 33 and 39 therefore make up stream 8, which is also the second current mentioned in the preamble of the present application. This stream, of a flow rate of approximately 21100 kg/h, contains only water and some traces of hydrocarbons.

The characteristics of stream 73 at the end of compression and drying operation 70 are as follows: a pressure of approximately 33 absolute bar, temperature of approximately 15° C., flow rate of approximately 272600 kg/h. It then undergoes a progressive cooling and partial liquefying operation 80 comprising five almost identical cooling stages in a cryogenic exchanger 62 and gas/liquid separating stages.

Stream 73 is cooled and partially liquefied a first time in cryogenic exchanger 62. In this case, each hydrocarbon is liquefied in increasing proportion to its molecular weight, the methane being liquefied in an extremely small proportion, with almost none of the hydrogen being liquefied. Resulting stream 74 then passes into a heat exchanger 43 in a counter-current direction, which brings its temperature to minus 36° C. and contributes towards liquefying the gas in a more complete manner, the cooling fluid being bottom liquid 66 of distillation column 64 which will be described below.

Cooled stream 75 which is obtained then feeds a gas/liquid separator 44 separating stream 40 into a gaseous stream 45 and a liquid stream 71. Liquid stream 71 undergoes expansion to 11.5 absolute bar which brings its temperature to approximately minus 48° C. and feeds a central level 64*a* of distillation column 64. It consists essentially of ethylene and ethane and contains a large majority of the $C_3$ and higher hydrocarbons supplied by stream 1.

Gaseous stream 45 is cooled and partially liquefied a second time in cryogenic exchanger 62. The residual amount of $C_3$ and higher hydrocarbons carried with gaseous stream 45 is liquefied almost completely. A large proportion of the ethane and the ethylene contained in stream 45 is liquefied as is a fraction of the methane of between 10% and 15%, with almost none of the hydrogen being liquefied.

Stream 45 then feeds a gas/liquid separator 46 separating stream 45 into a gaseous stream 47 and a liquid stream 48. Liquid stream 48 undergoes expansion to 11.5 absolute bar which brings its temperature to approximately minus 71° C. and feeds a second level 64*b* of distillation column 64 situated above feed level 64*a* with stream 71. It essentially consists of ethylene and ethane and contains methane and almost all of the $C_3$ and higher hydrocarbons which are not liquefied in the first cooling stage.

Gaseous stream 47 is cooled and partially liquefied a third time in cryogenic exchanger 62 to approximately minus 95° C. A large proportion of the ethane and ethylene carried in stream 47 is liquefied as is a fraction of the methane of between 10% and 20%, with almost none of the hydrogen being liquefied.

Stream 47 then feeds a gas/liquid separator 49 separating stream 47 into a gaseous stream 50 and a liquid stream 51. Liquid stream 51 undergoes expansion to 11.5 absolute bar which brings its temperature to approximately minus 95° C. and, after being mixed with streams liquefied in the following two cooling stages, feeds a top level 64*c* of distillation column 64. This stream 51 essentially consists of ethylene and ethane and contains methane.

Gaseous stream 50 is cooled and partially liquefied a fourth time in cryogenic exchanger 62, which brings its temperature to approximately minus 115° C. A large proportion of the ethane and the ethylene carried in stream 50 is liquefied as is a fraction of less than 15% of the methane, with almost none of the hydrogen being liquefied.

Stream 50 then feeds a gas/liquid separator 52 separating stream 50 into a gaseous stream 53 and a liquid stream 54. Liquid stream 54 undergoes expansion to 11.5 absolute bar which brings its temperature to approximately minus 121° C. and is mixed with stream 56 which was liquefied in the last cooling stage. This stream 54 essentially consists of ethylene and ethane and contains methane.

Gaseous stream 53 is cooled and partially liquefied a fifth time in cryogenic exchanger 62 to approximately minus 135° C. Almost all of the ethane and ethylene carried in stream 53 is liquefied as is a fraction of less than 15% of the methane, with almost none of the hydrogen being liquefied.

Stream 53 then feeds a gas/liquid separator 55 separating stream 53 into a gaseous stream 59 and a liquid stream 56. Liquid stream 56 undergoes expansion to 11.5 absolute bar and is mixed with stream 54 to form stream 57. Stream 56 essentially consists of ethylene and ethane and contains methane. Stream 57 is heated to minus 98° C. by passing into cryogenic exchanger 62, mixed with stream 51, and feeds a top level 64*c* of distillation column 64.

Following this fifth cooling stage, stream 59 only contains hydrogen and methane in notable amounts, the other hydrocarbons being traces. In particular, more than 99% of the ethane and the ethylene has been liquefied. Its mass flow rate is approximately 22000 kg/h, 9900 kg/h of which is hydrogen and 11400 kg/h of which is methane. Its pressure is approximately 31.3 absolute bar and its temperature approximately minus 135° C.

This stream 59 is divided into two streams 60 and 61, stream 60 representing only a few percent of the total mass flow rate. Stream 60 is heated in exchanger 62 to a temperature of 40° C. and is then collected, this stream being a part 76*a* of first current 76 mentioned in the introduction. Stream 61 also passes into exchanger 62, is heated to minus 104° C. and is expanded in a turbine 68 to a pressure of 7.7 bar and approximately minus 150° C. Expanded stream 78 is then heated a second time in exchanger 62 to 0° C. and is compressed to 10.8 absolute bar and approximately 41° C. using a compressor 69 coupled with turbine 68. It is then collected and makes up another part 76*b* of first current 76.

Gas streams 71, 48 and 58 liquefied during liquefying and cooling operation 80 undergo a distillation operation 90 essentially allowing the methane to be separated from the ethylene and the ethane.

As indicated above, these streams are injected into distillation column 64 at three different levels 64*a*, 64*b* and 64*c*. A stream 63 with a mass flow rate of approximately 1000 kg/h essentially containing ethylene is injected at a level 64*d* situated below level 64*a* where stream 71 is introduced. This stream 63 results from the compression of the evaporation gases of a cryogenic and atmospheric liquid storage of ethylene obtained by a further advanced separation of the stream resulting from operation 90, this method stage not being covered by the present patent and, consequently, not being described. This column allows the separation of a top stream 65 having a mass flow rate of approximately 27900 kg/h, a temperature of approximately minus 71° C. under a pressure of 11.3 absolute bar, and a bottom stream 66 having a mass flow rate of approximately 223700 kg/h, a temperature of approximately minus 41° C. under a pressure of 11.3 absolute bar. Gaseous stream 65 contains almost all of the methane and the hydrogen and a small fraction of the ethylene and the ethane coming from streams 71, 48 and 58, and almost no $C_3$ and higher hydrocarbons. It is recycled in the fourth compression stage of operation 70. Liquid stream 66 contains most of the ethylene, the ethane and almost all of the $C_3$ and higher hydrocarbons coming from streams 71, 48 and 58, and contains almost no methane and hydrogen. This stream 66 is compressed by pump 67 to 25 bar, heated in exchanger 62 to approximately minus 11° C., then collected. The mass flow rates of the main constituents are as follows.

| Water | $H_2$ | CO | $CO_2$ | Methane | Ethylene | Ethane |
|---|---|---|---|---|---|---|
| 0 | 0 | 0 | 0 | 9 | 127100 | 83700 |

| Propene | 1,3-Butadiene | n-Butane | Benzene |
|---|---|---|---|
| 2700 | 3100 | 1400 | 3500 |

It makes up third current 77 defined in the preamble.

The cooling of main exchanger 62 is mainly ensured by a feed stream 400 of LNG under approximately 52 bar relative. The feed temperature of the LNG can typically vary between minus 89° C. and minus 160° C., the flow rate necessary for providing the cooling power consequently varying between 100800 and 176600 kg/h.

Stream 400 is then separated into a medium pressure stream 401 and a high-pressure stream 402, stream 401 undergoing expansion to 30 bar which reduces its temperature. The flow rate of stream 401 depends on the feed temperature of the LNG, this flow rate being all the more large since the temperature is low.

In an embodiment where the feed temperature is minus 89° C., the flow rate of stream 401 is approximately 17700 kg/h and the temperature of the LNG after expansion to 30 absolute bar is minus 99° C. In this case, the cooling required for cooling stream 50 to minus 115° C. and stream 53 to minus 135° C. comes from stream 61 after expansion in turbine 68.

In an embodiment where the feed temperature is minus 160° C., the flow rate of stream 401 is nil.

Streams 402 and/or 401 feed cryogenic exchanger 62 and undergo complete evaporation. The cooling released during this evaporation acts to cool various streams passing through exchanger 62. The output temperature of streams 401 and 402 is approximately 30° C.

A related cold recovery cycle typically with butane comprising at least a storage tank 701 and a circulation pump 702 ensures the cooling of exchanger 38 and possibly other exchangers 703. Cryogenic exchanger 62 carries out the function of the exchanger providing cooling to this cycle.

In operations 70, 80 and 90 described above, the CO contained in stream 1 acts substantially like hydrogen and the possible $C_2$ hydrocarbons act substantially like ethylene and ethane.

In an alternative embodiment, compressors 3, 10, 17, 24 and 36 can be replaced with a single multi-stage compressor.

It clearly emerges from this description that the large mass flow rates of gas to be treated and the extremely low temperatures necessary for the liquefaction of hydrocarbon pyrolysis gases require a large cooling capacity. The traditional cooling cycles of this size are extremely costly. The use of the refrigeration provided by the LNG during its regasification allows these cycles to be almost completely eliminated. It allows the cooling power of the LNG to be efficiently used, which would otherwise be lost. The thermal powers used in the prior art and according to the invention are approximately indicated in the table below:

| | | prior | with LNG according to the invention | | |
|---|---|---|---|---|---|
| Case | | art | case 1 | case 2 | case 3 |
| Necessary cooling | | | | | |
| Power of the secondary cycle | kW | 10800 | 0 | 0 | 0 |
| Power of the tertiary cycle | kW | 9900 | 0 | 0 | 0 |
| Total | kW | 20700 | 0 | 0 | 0 |
| Liquefied natural gas used | | | | | |
| Vapourised LNG flow rate | kg/h | 0 | 176600 | 119600 | 100800 |
| Vapourisation heat of the LNG | kW | 0 | 27100 | 25800 | 24100 |
| Temperature of the LNG | ° C. | | minus 89.4 | minus 135 | minus 158.8 |
| Pressure of the LNG | bar | | 52 | 52 | 52 |
| Natural gas produced | | | | | |
| Temperature | ° C. | | 30 | 30 | 30 |
| Gas at 30 bar | kg/h | | 17600 | 0 | 0 |
| Gas at 50 bar | kg/h | | 159000 | 119600 | 100800 |

The invention claimed is:

1. A method of fractionating a gas produced by the pyrolysis of hydrocarbons, encompassing hydrogen and $C_1$ to $C_4$ hydrocarbons including ethylene, ethane and methane, and possibly water and $CO_2$, into at least a first current enriched in hydrogen and methane, and possibly at least a second current essentially consisting of water, the method comprising:

a) compressing and drying the gas, passing the gas into a series of compressors, each connected to respective a cooler and a respective separator and further comprising a $CO_2$-removal stage, if the gas contains a surplus of $CO_2$, in order to obtain a compressed gas, b) progressively cooling and partially liquefying the compressed gas produced by the compressing and drying operation a), caused by successively passing the gas into a cryogenic exchanger and separating the gas in separators into (i) liquids respectively enriched in $C_2$ and higher hydrocarbons, including ethylene and ethane, but low in hydrogen and methane, and into (ii) gases respectively depleted in $C_2$ and higher hydrocarbons, of ethylene and ethane, wherein each successive passage into a cryogenic exchanger bringing the gases to a relatively lower temperature for allowing the hydrocarbons to be liquefied in a more complete manner, wherein separator gas produced by a last separator makes up a first current essentially containing hydrogen and methane and a very small amount of ethylene and ethane, then collecting the separator gas, cooling the cryogenic exchanger by at least one cooling fluid which is liquid natural gas, c) forming the gas undergoing the progressive cooling and partial liquefaction operation b) with the gas produced in the compression and drying operation a), d) distilling in a column, supplied at various levels with liquids collected during operation b) and partially expanded, the column allowing separation, into a relatively colder upper part, of a gaseous top current enriched in methane and depleted in ethylene and ethane, and, into a relatively less cold lower part, of a liquid bottom current depleted in methane and enriched in ethylene and ethane, recycling the top current during operation a) upstream of the compressor, the feed pressure of which is closest to the operating pressure of the distilling column, at the bottom current and collecting and making up a third current containing most of the other $C_2$ and higher hydrocarbons including, ethylene and ethane, e) feeding of LNG into the cryogenic exchanger at a temperature that is variable from minus 89° C. to minus 160° C.;

f) heating the separator gas produced by the last separator, the top current and the bottom current in the cryogenic exchanger.

2. A method of fractionating a gas produced by the pyrolysis of hydrocarbons according to claim 1, further comprising dividing the separator gas produced by the last separator into a stream heated in the cryogenic exchanger and a stream expanded and cooled in a turbine and then heated in the cryogenic exchanger.

3. A method of fractionating a gas produced by the pyrolysis of hydrocarbons according to claim 1, further comprising feeding the cryogenic exchanger with two streams of LNG, including a high pressure stream at a first, relatively higher pressure and a medium pressure stream at a second, relatively lower pressure.

4. A method of fractionating a gas produced by the pyrolysis of hydrocarbons according to claim 3, further comprising producing the medium pressure stream of LNG for feeding the cryogenic exchanger by deriving a part of high pressure stream and expanding the high pressure stream in order to reduce its temperature, wherein the flow rate of the medium pressure stream depends on the temperature of the LNG stream and the flow rate of the medium pressure being larger when the temperature is high.

5. An installation for fractionating a gas produced by the pyrolysis of hydrocarbons, encompassing hydrogen and $C_1$ to $C_4$ hydrocarbons including ethylene, ethane and methane, and possibly water and $CO_2$, into at least a first current enriched in hydrogen and methane, and possibly at least a second current essentially consisting of water, the installation comprising:

a) a first unit operable for compressing and drying gas by passing the gas in a path of the gas including a series of compressors, each of the compressors being connected to a respective cooler and a respective separator and the path including a further $CO_2$-removal stage, if the gas contains a surplus of $CO_2$, in order to obtain a compressed gas, b) a second unit operable for progressively cooling and partially liquefying the compressed gas produced by the first compressing and drying unit, the second unit comprising a cryogenic exchanger and separators through which the compressed gas is successively passed and separated in the separators into (i) liquids respectively enriched in $C_2$ and higher hydrocarbons, including ethylene and ethane, but low in hydrogen and methane, and (ii) gases respectively depleted in $C_2$ and higher hydrocarbons including ethylene and ethane, by each successive passage into the cryogenic exchanger bringing gases to a relatively lower temperature and therefore allowing the hydrocarbons to be liquefied in a more complete manner, and a last separator operable for making up a first gas current essentially containing hydrogen and methane and a very small amount of ethylene and ethane, the gas of the first gas current then being collected, and the cryogenic exchanger being cooled by at least one cooling fluid which is liquid natural gas, c) a third distillation unit operable for:

d) progressive cooling and partial liquefaction the gas produced in the first compression and drying unit;

e) the distillation unit essentially comprises a column, configured and operable to be supplied at various levels with liquids collected in the progressive cooling and partial liquefaction unit and partially expanded, the column allowing the separation, into a relatively colder upper part, of a gaseous top current enriched in methane and depleted in ethylene and ethane, and, into a relatively less cold lower part, of a liquid bottom current depleted in methane and enriched in ethylene and ethane, wherein the top current is recycled in the unit upstream of the compressor, the feed pressure of the first unit is closest to the operating pressure of the column, and the bottom current being collected and making up a third current containing most of the other $C_2$ and higher hydrocarbons, including ethylene and ethane, f) a supply of LNG which enters the cryogenic exchanger at a temperature which can vary from minus 89° C. to minus 160° C.; and g) wherein the gas produced by the last separator, the top current and the bottom current are heated in the cryogenic exchanger.

6. An installation for fractionating a gas produced by the pyrolysis of hydrocarbon according to claim 5, wherein the last separator is operable so that the gas it produces is divided into a first stream heated in the cryogenic exchanger and a second stream, a turbine in which the second stream is expanded and cooled and the second stream is then heated in the cryogenic exchanger.

7. An installation for fractionating a gas produced by the pyrolysis of hydrocarbons according to claim 5, wherein the supply of LNG is operable to feed cryogenic exchanger is fed with two streams of LNG, including a high pressure stream at a first, relatively higher pressure and a medium pressure stream at a second, relatively lower pressure.

8. An installation for fractionating a gas produced by the pyrolysis of hydrocarbons according to claim 7, wherein the medium pressure stream of LNG which feeds the cryogenic exchanger is produced by deriving a part of the high pressure stream and expanding the high pressure stream to reduce its temperature, wherein the flow rate of the medium pressure stream depends on the temperature of the LNG stream (400) and the flow rate being larger when the temperature is high.

9. A method of fractionating a gas produced by the pyrolysis of hydrocarbons according to claim 2, further comprising feeding the cryogenic exchanger with two streams of LNG, including a high pressure stream at a first, relatively higher pressure and a medium pressure stream at a second, relatively lower pressure.

10. An installation for fractionating a gas produced by the pyrolysis of hydrocarbons according to claim 6, wherein the supply of LNG is operable to feed the cryogenic exchanger with two streams of LNG, including a high pressure stream at a first, relatively higher pressure and a medium pressure stream at a second, relatively lower pressure.

* * * * *